US006428431B1

(12) United States Patent
Seaver et al.

(10) Patent No.: US 6,428,431 B1
(45) Date of Patent: Aug. 6, 2002

(54) PORTABLE GOAL APPARATUS FOR USE IN SWIMMING POOL-BASED ACTIVITIES

(75) Inventors: John Carlton Seaver; Nicholas C. E. Seaver, both of Arcadia, CA (US)

(73) Assignee: TrueGoal LLC, Arcadia, CA (US)

( * ) Notice: Subject to any disclaimer, the term of this patent is extended or adjusted under 35 U.S.C. 154(b) by 0 days.

(21) Appl. No.: 09/655,496

(22) Filed: Sep. 5, 2000

Related U.S. Application Data

(60) Provisional application No. 60/152,347, filed on Sep. 7, 1999.

(51) Int. Cl.[7] ..... A63B 67/00
(52) U.S. Cl. ..... 473/466
(58) Field of Search ..... 473/466, 481, 473/471, 469, 197, 476, 478, 454, 456; 273/395, 396, 398–402, 348, 350

(56) References Cited

U.S. PATENT DOCUMENTS 2,818,254 A * 12/1957 Dunn ..... 473/481
3,743,286 A * 7/1973 Weinhagen et al. ..... 473/481
4,220,337 A * 9/1980 Moore ..... 273/395
4,759,545 A 7/1988 Grable
4,786,053 A 11/1988 Barnes, Jr.
5,112,023 A 5/1992 Sowers
5,249,796 A * 10/1993 Silvi ..... 473/416
5,421,586 A * 6/1995 Amram et al. ..... 273/400
6,070,879 A 6/2000 Kemp
6,113,506 A * 9/2000 Nielsen ..... 473/466
6,220,975 B1 * 4/2001 Bezley ..... 473/466

FOREIGN PATENT DOCUMENTS

GB 2172509 * 3/1985

* cited by examiner

*Primary Examiner*—Mark S. Graham
(74) *Attorney, Agent, or Firm*—Henricks, Slavin & Holmes LLP

(57) ABSTRACT

An apparatus for use with a swimming pool. The apparatus includes an athletic goal, a ballast device, and a support assembly operably connecting the athletic goal to the ballast device such that bottom portion of the goal will be below the ballast device when the ballast device is on the top surface of the deck and the athletic goal is within the interior region of the swimming pool.

16 Claims, 4 Drawing Sheets

PORTABLE GOAL APPARATUS FOR USE IN SWIMMING POOL-BASED ACTIVITIES

CROSS-REFERENCE TO RELATED APPLICATIONS

This application is a continuation-in-part of, and claims the benefit of, provisional U.S. application Ser. No. 60/152,347, filed Sep. 7, 1999, which is incorporated herein by reference in its entirety.

BACKGROUND OF THE INVENTION

1. Field of Invention

The present invention relates generally to swimming pools and, more particularly, to portable goals for use in water polo and other swimming pool-based activities.

2. Description of the Related Art

Water polo is a swimming game that is in many ways similar to soccer, football, basketball, and hockey. The game is played in a swimming pool by two seven person teams. The object of the game is to maneuver a buoyant ball using one's head, feet, and hands (albeit one hand at a time) into the appropriate one of two goals located at the opposite ends of the pool. The goals extend upwardly from the water line and typically include a pair of horizontally spaced vertically extending goal posts and a crossbar extending from the top of one goal post to the top of the other. The goals also include nets that capture the ball after it passes through the goals. A regulation water polo goal is 3 m wide (about 10 feet ), 90 cm high (about 35 inches) measured from the water line to the crossbar and 30 cm deep (about 12 inches). Like soccer and hockey, goalies are positioned in front of the goals.

The water polo ball typically weighs between 400–450 g (about one pound) and can be shot at the goal at speeds approaching 40 miles per hour. In addition to directing shots straight through the goal, players will often attempt to carom the ball off one of the goal posts or the crossbar in order to avoid the goalie while, at the same time, directing the ball through the goal posts into the net. These shots, which are commonly referred to as "bar ins," necessitate that the goal posts, crossbar and underlying support structure be rigid in and of themselves and the manner in which they are held in place. Failure to provide a sufficiently rigid structure will result in deflection of the goalposts and crossbar and/or movement of the entire goal when struck by the ball. This is, of course, undesirable because bending and movement of the goalposts or crossbar will alter the trajectory of the ball and movement of the goal itself requires play to be stopped so that the goal can be repositioned.

One type of conventional water polo goal is the so-called "deck goal," which is fixedly mounted on the edge of the swimming pool deck such that the goalposts are positioned beyond the edge of the deck and extend downwardly to the water line. The deck goal typically includes a rigid metal support structure with a pair of downwardly extending support posts. The support posts mate with the holes that must be drilled into the pool deck. Another conventional water polo goal is the so-called "floating goal." A floating goal includes a floating support system that positions a suitably sturdy water polo goal on the water surface. An anchor system is required to hold the floating goal in place.

Although the goals in a regulation swimming pool in which the official games are played are typically fixed in place at opposite ends of the pool, there are many reasons to move a water polo goal. It can, for example, be desirable to move the goal around, or add additional goals to, a regulation swimming pool for practice purposes. Water polo players also desire to play and practice their sport in pools other than regulation swimming pools. Backyard swimming pools and club pools are frequent choices. Conventional deck goals, however, are not well suited for movement around a regulation swimming pool because each new location requires a new set of holes. Similarly, deck goals are not well suited for use in backyard or club swimming pools because holes must be drilled into the deck, which is expensive and unsightly. Turning to floating goals, not only are they prohibitively expensive for backyard and club swimming pool use, they are also so big that they occupy an unacceptably large portion of many pools.

More recently, the introduction of portable water polo goals, which may be used in conjunction with any swimming pool, has enabled the movement of goals and has allowed water polo players to enjoy their sport in backyard and club pools. Conventional portable water polo goals consist essentially of a goalpost, crossbar and support arrangement that is designed to be positioned on top of the pool deck adjacent to the pool edge. Such goals also include a ballast device for holding the goal in place. One such portable goal is disclosed in U.S. Pat. No. 4,786,053 to Barns, Jr.

The inventors herein have determined that although they are useful, conventional portable water polo goals suffer from a number of shortcomings. For example, the inventors herein have determined that the portable goals introduced heretofore are not designed to extend to the water line. As a result, low flying shots on goal, which would have resulted in the ball striking the goal post of a deck goal or floating goal, instead strike the portion of the pool wall between the waterline and deck surface. This makes it difficult to determine whether a goal was scored by low flying shots near the goal posts. It also prevents low flying "bar in" shots that deflect off of the goal posts. The inventors herein have also determined that conventional portable goals tend to deflect and/or move when struck by balls traveling at a high speeds. Such deflection and movement is unacceptable because, as noted above, shots will not properly carom off the goal posts or crossbar and, when the goal moves, play must be stopped to reorient the goal.

SUMMARY OF THE INVENTION

Accordingly, the general object of the present invention is to provide a portable swimming pool-based athletic goal that solves, for practical purposes, the aforementioned problems in the art. Another object of the present invention is to provide a portable water polo goal is configured such that shots cannot pass between the bottom of the goal posts and the waterline. Still another object of the present invention is to provide a portable athletic goal that will not move an appreciable distance when struck by a ball or other flying object. Yet another object of the present invention is to provide a rigid structure that will resist the bending forces associated attendant to being struck by a ball or other flying object.

In order to accomplish some of these and other objectives, an apparatus for use with a swimming pool in accordance with a preferred embodiment of the present invention includes an athletic goal, a ballast device, and a support assembly operably connecting the athletic goal to the ballast device such that bottom portion of the goal will be below the ballast device when the ballast device is on the top surface of the deck and the athletic goal is within the interior of the swimming pool.

In order to accomplish some of these and other objectives, an apparatus for use with a swimming pool in accordance with another preferred embodiment of the present invention includes an athletic goal, a ballast device, and a support assembly operably connecting the athletic goal to the ballast device and adapted to engage both the top surface and the edge of the pool deck.

In order to accomplish some of these and other objectives, an apparatus for use with a swimming pool in accordance with still another preferred embodiment of the present invention includes an athletic goal, a ballast device, a support assembly operably connecting the athletic goal to the ballast device, and a tension device adapted to apply tension to at least a portion of the athletic goal to urge the athletic goal against a portion of the support assembly.

The present invention provides a number of advantages over conventional portable swimming pool-based goals. For example, an embodiment of the present invention including a goal that is supported such that the bottom portion of the goal is below the ballast device may be configured such that the bottom portion of the goal will be at or near the waterline of the associated pool. As a result, low flying shots that would fly under the goal posts of a conventional portable water polo goal and strike the pool wall between the waterline and deck surface will instead strike the goal posts of this embodiment of the present invention. An embodiment of the present invention which includes a support assembly that engages both the top surface and the edge of the deck will be less like to move back away from the edge when struck by a ball, as compared to a conventional portable water polo goal. An embodiment of the present invention which includes a tension device adapted to apply tension to the athletic goal to urge the athletic goal against a portion of the support assembly will result in an overall structure that is rigid an unlikely to deflect when struck by a water polo ball.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. Additionally, although the invention is described below in the context of a portable water polo goal, the invention has application in all swimming pool-based activities that involve the use of a portable goal.

Figure 1:
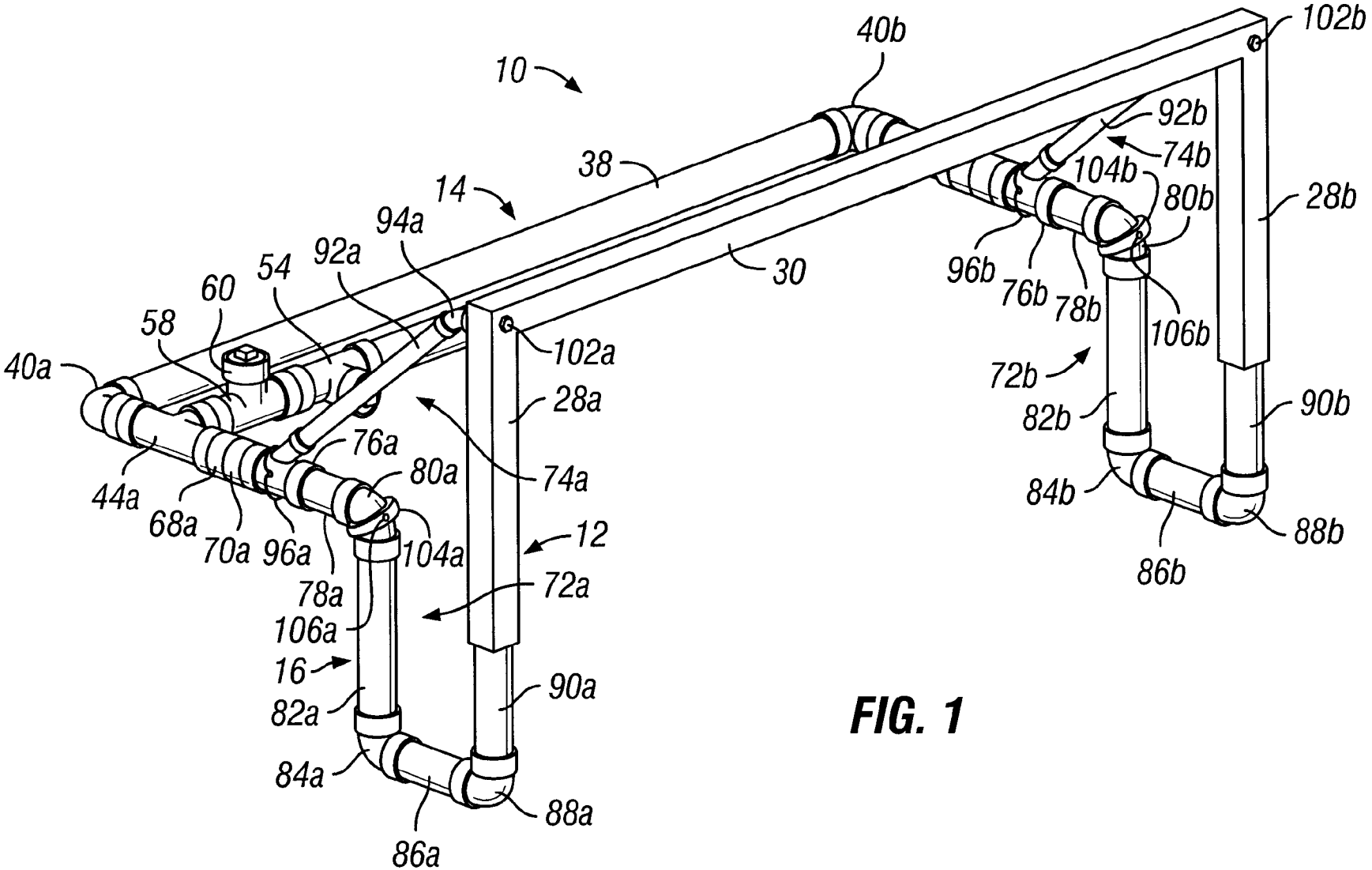
FIG. 1 is a perspective view of a portable water polo goal in accordance with a preferred embodiment of the present invention.
Figure 2:
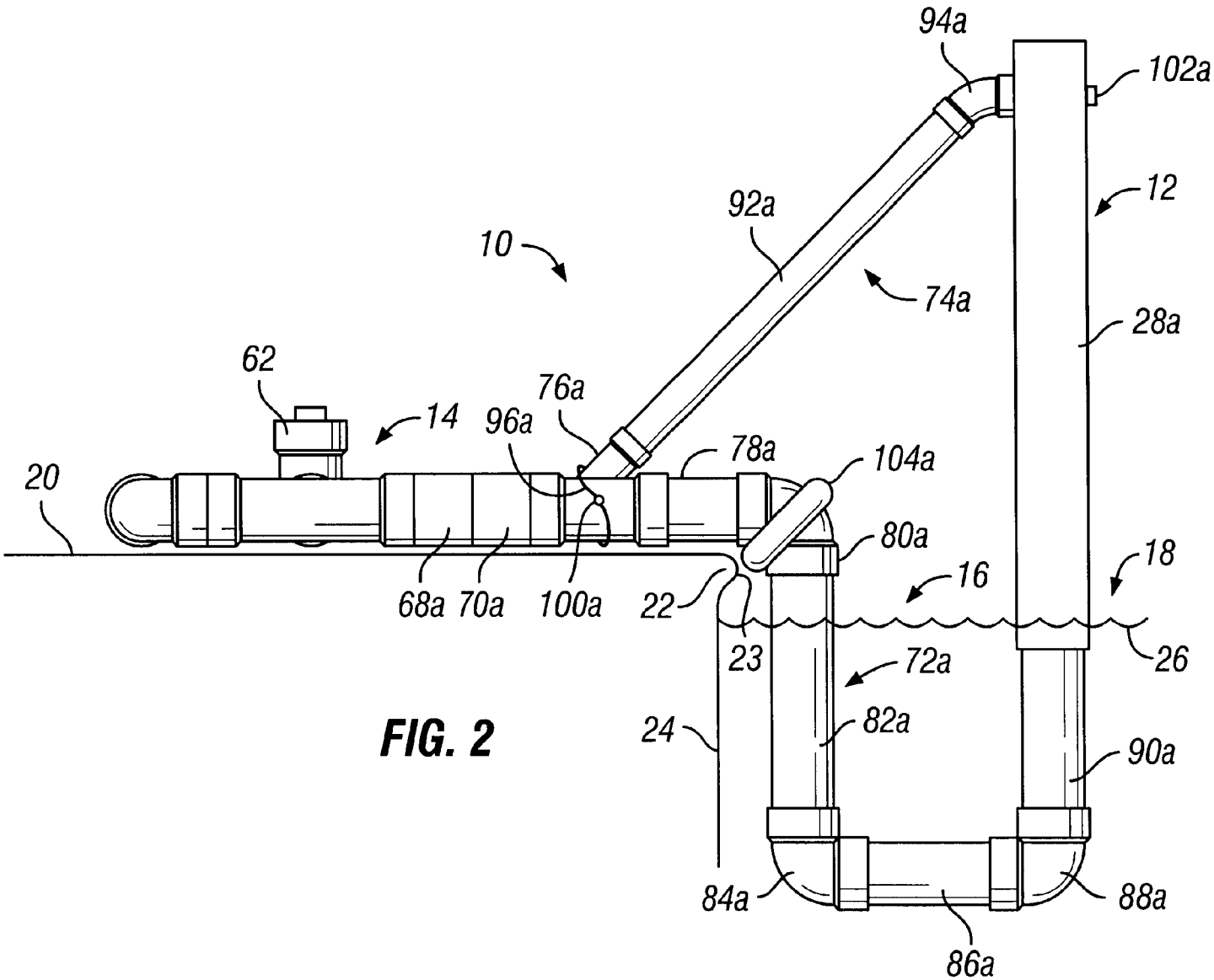
FIG. 2 is a side view showing the portable water polo goal illustrated in FIG. 1 deployed in a swimming pool.

As illustrated for example in FIGS. 1 and 2, a portable water polo goal (or "goal") 10 in accordance with a preferred embodiment of a present invention includes a goal frame 12, a ballast device 14 and a support assembly 16 that supports the goal frame relative to the ballast device. The goal 10 may be used in conjunction with a swimming pool 18 having a deck 20, coping 22 with an edge 23, and a wall 24. More specifically, the goal 10 may be positioned such that the ballast device 14 rests on the deck 20 while the support assembly 16 supports the goal frame 12 below the ballast device. The goal frame 12 will be located within the swimming pool 18 below the deck 20 such that the bottom portion of the goal frame is at or near the water line 26 and the top portion of the goal is the appropriated distance from the water line, i.e. 90 cm (about 35 inches). As will be explained in greater detail below, a portion of the support assembly 16 will abut at least the coping edge 23 and, in pools that do not include inwardly extending coping, will abut the wall 24. A net (not shown) may be positioned position over the goal frame 12 in the conventional manner.

The exemplary goal frame 12, which includes a pair of goal posts 28*a* and 28*b* and a crossbar 30, is preferably formed from square aluminum tubing that is 7.5 cm (about 3.0 inches) on each side and 0.65 cm (about 0.25 inch) thick. Square tubing formed from stainless steel or other materials may also be used. Regardless of the material used, it is important that the goal posts 28*a* and 28*b* and crossbar 30 together form a rigid structure that will not bend when struck by a water polo ball.

Figure 3:
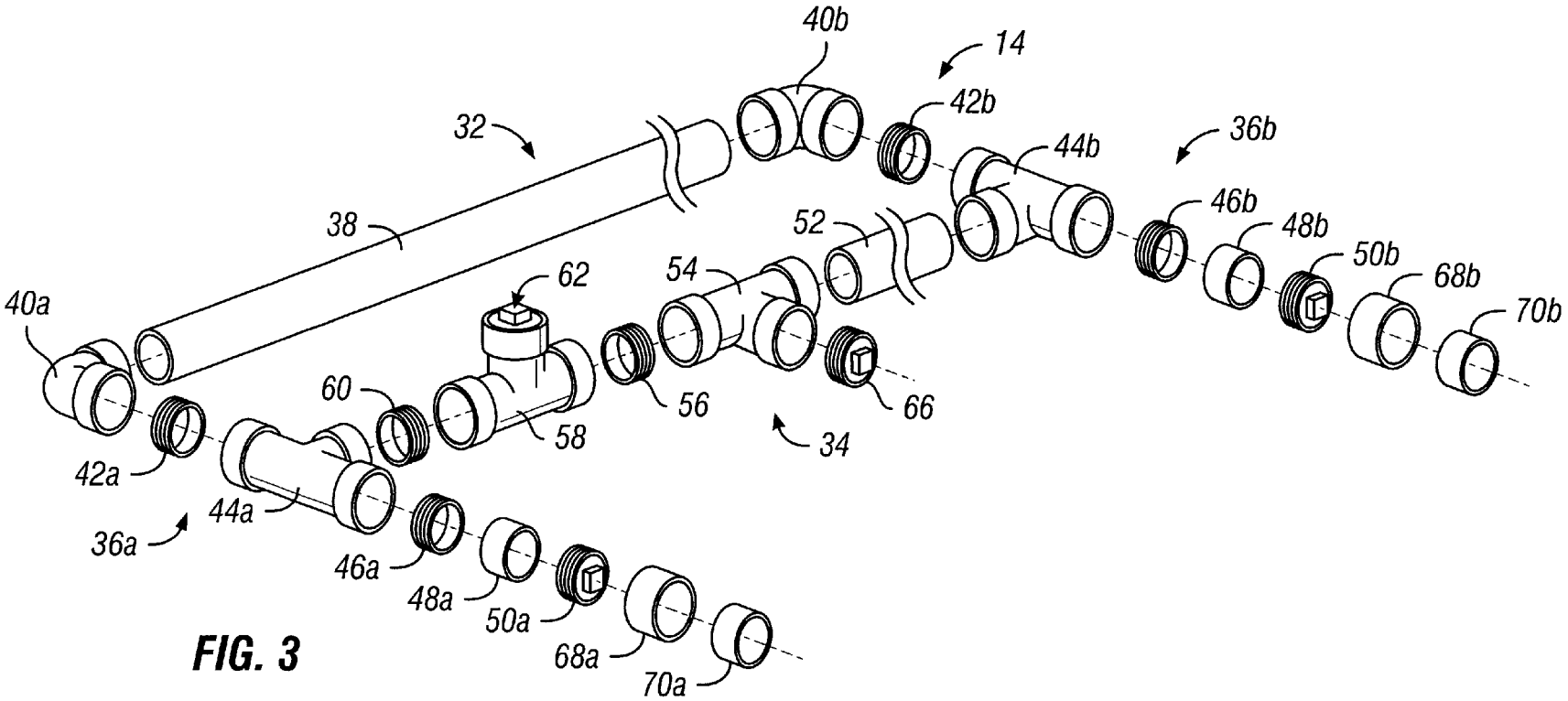
FIG. 3 is an exploded perspective view of a ballast device that may be used in conjunction with the portable water polo goal illustrated in FIG. 1.
Figure 4:
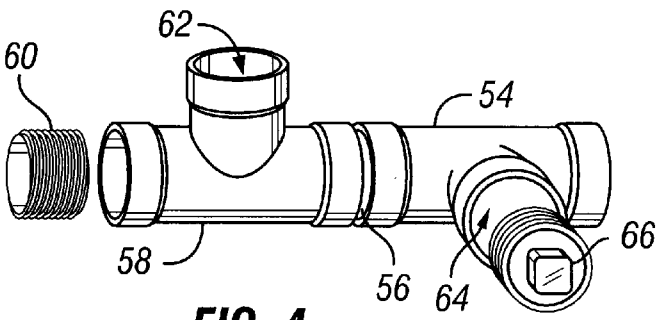
FIG. 4 is a perspective view of a portion of the ballast device illustrated in FIG. 3.

As illustrated for example in FIGS. 3 and 4, the exemplary ballast device 14 includes of a series of connected tubular structures—a rear structure 32, a middle structure 34 and a pair of side structures 36*a* and 36*b*. The tubular structures in the exemplary embodiment are primarily formed from threaded pipes, joints and adapters (collectively "piping") with an internal diameter of about 7.6 cm (about 3.0 inches). The piping should be rigid enough to prevent bending. Plastic piping, such as Acrylo Butadiene Styrene (ABS) piping, is preferred. Metal piping may also be used. Also, although the exemplary piping is circular in cross-section, piping having other cross-sectional shapes may also be employed.

The rear structure 32 in the preferred embodiment includes a pipe 38 and a pair of 90 degree joints 40*a* and 40*b*. The joints 40*a* and 40*b* are secured to side structure pipes 42*a* and 42*b*, which are in turn secured to three-way T-joints 44*a* and 44*b*. One of the other ends of the T-joints 44*a* and 44*b* is connected to the remainders of the side structures—pipes 46*a* and 46*b*, threaded female adapters 48*a* and 48*b*, and plugs 50 and 50*b*. The plugs 50*a* and 50*b* prevent the ballast material from entering the support assembly 16 and goal frame 12. Preventing ballast material from entering the support assembly 16 and goal frame 12 is important because it reduces the weight of the support assembly and goal frame relative to the ballast device 14, thereby preventing the goal 10 from pivoting about the edge of the swimming pool 18 and falling into the pool.

The remaining ends of the T-joints 44*a* and 44*b* are connected to the middle structure 34. The middle structure 34 includes a pipe 52, a three-way T-joint 54, a pipe 56, a three-way T-joint 58 and a pipe 60. Referring more specifically to FIG. 4, one end of the T-joint 54 faces upwardly and is not connected to a pipe, thereby defining a ballast material inlet 62. An inlet plug (not shown) may be provided, but is not required. One end of the T-joint 58 is also not connected to a pipe. Here, however, the open end faces horizontally to define a ballast material outlet 64. A threaded outlet plug 66 prevents the ballast material from passing through the outlet until desired. Rubber stoppers and other suitable devices may also be used to cap the outlet 64.

The preferred ballast material is water. It should be noted, however, that any material which will flow in to and out of the ballast device 14 may be used. Sand is one example of such a material. Once the exemplary goal 10 has been positioned adjacent to the swimming pool, the ballast device 14 may be filled with water by way of the inlet 62. The water may be released when the user desires to move the goal 10 by unscrewing the outlet plug 66 to release the ballast material.

The connections between the pipes, T-joints and adapters in the exemplary ballast device 14 are preferably sealed so as to be water tight. Adhesive material suitable for use with the particular piping material forming the ballast device may be used to form the seal. If, for example, the ballast device is formed from ABS piping, then ABS glue may be used to form the seals.

Other ballast devices may also be employed. For example, instead of a series of connected tubular structures, the ballast device may consist primarily of a relatively large, single reservoir that is connected to the support assembly 16. Finally, although they are less desirable alternatives, more permanent ballasting devices that do not rely on water or other ballast material that flows may also be used. For example, one or more sufficiently heavy weights that can be releasably bolted or otherwise connected to a structure that extends rearwardly from the support assembly 16 in a manner similar to the ballast device 14 may be used.

The exemplary support assembly 16, which is illustrated in FIGS. 1, 2 and is secured to the ballast device 14 by female adapters 68*a* and 68*b* and pipes 70*a* and 70*b*, includes lower support structures 72*a* and 72*b* and upper support structures 74*a* and 74*b* that are preferably formed from the same materials as the ballast device 14. The upper and lower support structures are secured to the pipes 70*a* and 70*b* by three-way Y-joints 76*a* and 76*b*. The lower support structures 72*a* and 72*b* extend downwardly into the swimming pool, inwardly and then upwardly to support the goal frame 12. As best seen in FIG. 2, the present support assembly 16 will engage the pool edge 23, which will advantageously prevent the goal 10 from moving back when struck by a ball.

The lower support structures 72*a* and 72*b* in the exemplary embodiment include horizontally extending pipes 78*a* and 78*b*, 90 degree joints 80*a* and 80*b*, downwardly extending pipes 82*a* and 82*b*, 90 degree joints 84*a* and 84*b*, horizontally extending pipes 86*a* and 86*b*, 90 degree joints 88*a* and 88*b*, and upwardly extending pipes 90*a* and 90*b* on which the goal posts 28*a* and 28*b* are mounted. The upper support structures 74*a* and 74*b* includes pipes 92*a* and 92*b*, which are connected to the Y-joints 76*a* and 76*b*, and 45 degree joints 94*a* and 94*b*which abut the top of the goal frame 12.

Figure 5:
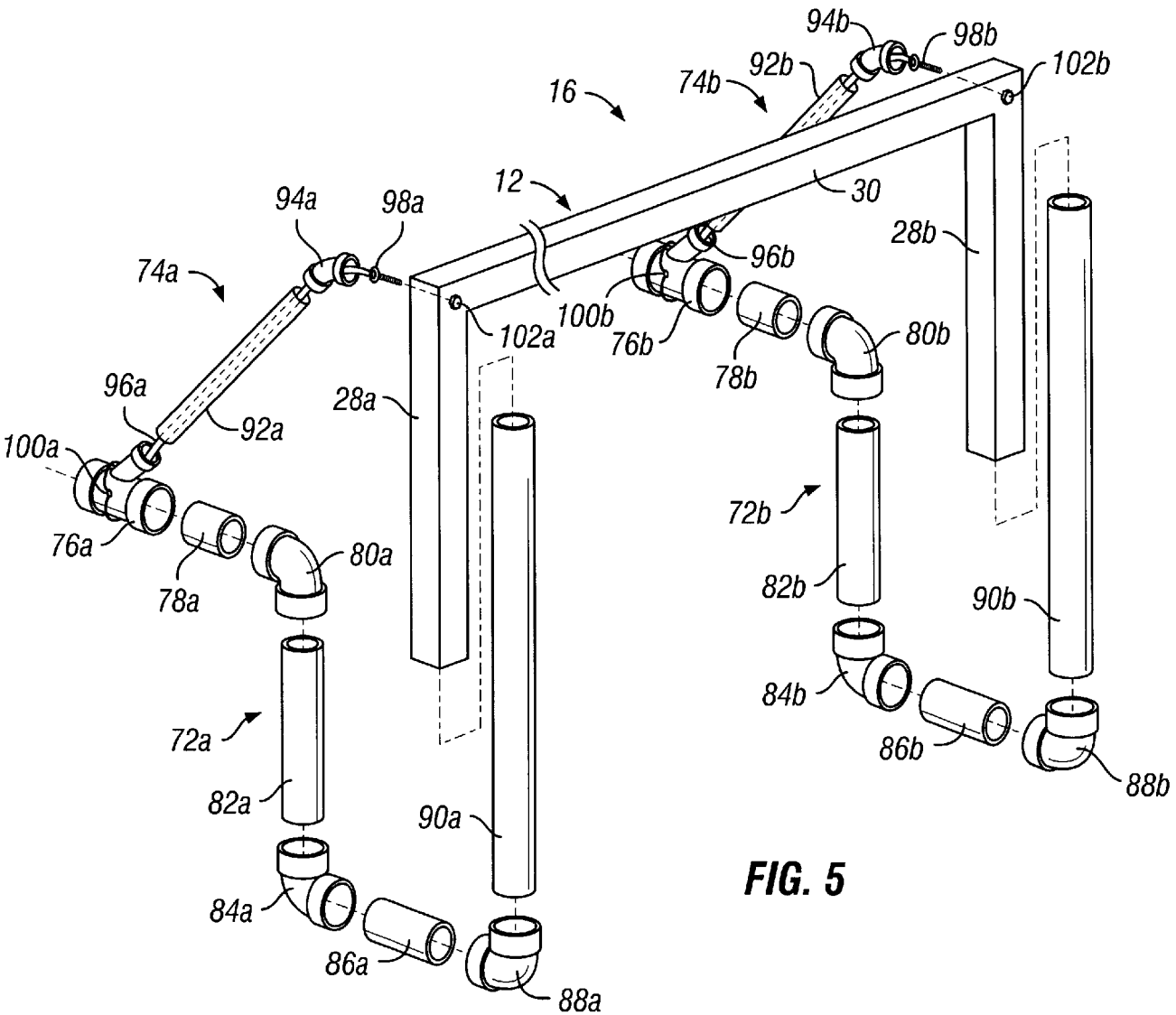
FIG. 5 is an exploded perspective view of a portion of the water polo goal illustrated in FIG. 1.

Referring more specifically to FIG. 5, the exemplary support system 16 is also provided with a tensioning system that pulls the goal frame 12 tightly against the 45 degree joints 94*a* and 94*b* to form a rigid structure that will not pivot about the lower support structures 72*a* and 72*b* toward or away from the pool deck when struck by a water polo ball. The tensioning system includes cords 96*a* and 96*b*, which may formed from rope, wire, cable or any other suitable device, that extend from eye bolts 98*a* and 98*b* located within the upper corners of the goal frame 12 to and through apertures 100*a* and 100*b* in the Y-joints 76*a* and 76*b*. The cords 96*a* and 96*b* are tied around a portion of the Y-joints 76*a* and 76*b* once sufficient tension has been applied. The eye bolts 98*a* and 98*b* are held in place with nuts 102*a* and 102*b*. Alternatively, the Y-joints 76*a* and 76*b* may be provided with crank and ratchet assemblies for use in tightening the cords 96*a* and 96*b*.

It should be noted that because there is no ballast material or tensioning ropes located within the lower support structures 72*a* and 72*b*, hollow piping is not required. Nevertheless, because of its superior strength to weight ratio, hollow piping is preferred.

The preferred embodiment may include a pair of anti-slip devices 104*a* and 104*b* to prevent lateral movement of the goal 10 relative to the swimming pool 18, as is illustrated for example in FIGS. 1 and 2. The anti-slip devices 104*a* and 104*b*, which are preferably formed from textured rubber or other suitable materials, may be held in place on the support system 16 with set screws 106*a* and 106*b*. Additional anti-slip devices may also be provided at other locations as desired.

Although the present invention has been described in terms of the preferred embodiment above, numerous modifications and/or additions to the above-described preferred embodiments would be readily apparent to one skilled in the art. By way of example, but not limitation, the present ballast device 14 and support system 16 may, for example, be used to support a basketball backboard and hoop instead of a water polo goal frame. It is intended that the scope of the present invention extends to all such modifications and/or additions.

We claim:

1. An apparatus for use with a swimming pool having a deck, defining a top surface and an edge extending downwardly from the top surface, and having an interior region at least partially filled with water defining a water line, the apparatus comprising:

an athletic goal defining a bottom portion;

a ballast device including at least one hollow ballast storage member which defines an interior ballast storage region that removably stores ballast material and rests directly on the top surface of the deck when the athletic goal is within the interior region of the swimming pool; and a support assembly operably connecting the athletic goal to the ballast device such that the bottom portion of the athletic goal will be below the ballast device when the ballast device is on the top surface of the deck and the athletic goal is within the interior region of the swimming pool, the support assembly including at least one hollow support member connected to the at least one hollow ballast storage member and defining a support member interior region;

wherein the interior ballast storage region and the support member interior region are separated by a plug.

2. An apparatus as claimed in claim 1, wherein the athletic goal comprises a pair of goal posts.

3. An apparatus as claimed in claim 2, wherein the athletic goal further comprises a crossbar extending from one goal post to the other goal post.

4. An apparatus as claimed in claim 1, wherein the support assembly includes horizontal members adapted to rest on the deck, downwardly extending members, inwardly extending members, and upwardly extending members.

5. An apparatus as claimed in claim 4, wherein the athletic goal is supported on the upwardly extending members.

6. An apparatus as claimed in claim 4, wherein the ballast device and support assembly are arranged relative to one another such that an approximately 90 degree angle is defined between ballast device and the downwardly extending members.

7. An apparatus as claimed in claim 1, wherein the ballast device and support assembly are arranged relative to one another such that at least a portion of the support assembly will engage the edge of the deck when the ballast device rests on the top surface of the deck.

8. An apparatus as claimed in claim 7, wherein the ballast device and support assembly are arranged relative to one another such that the bottom portion of the athletic goal will be substantially adjacent to the water line when the ballast device rests on the top surface of the deck.

9. An apparatus as claimed in claim 1, wherein the athletic goal defines a top portion and the support assembly supports the athletic goal at two spaced locations along the bottom portion and two spaced locations along the top portion.

10. An apparatus as claimed in claim 1, wherein the athletic goal comprises a water polo goal.

11. An apparatus as claimed in claim 1, wherein the ballast device is isolated from the athletic goal and support assembly such that the ballast material is prevented from entering the athletic goal and support assembly.

12. An apparatus as claimed in claim 1, wherein the at least one hollow ballast storage member comprises a plurality of hollow ballast storage members defining respective interior ballast storage regions and the interior ballast storage regions are in fluid communication with one another.

13. An apparatus for use with a swimming pool having a deck, defining a top surface and an edge extending downwardly from the top surface, and having an interior region at least partially filled with water defining a water line, the apparatus comprising:

an athletic goal including a metal cross-bar and a pair of hollow metal posts that extend downwardly from the cross-bar;

a ballast device adapted to removably store ballast material; and a support assembly operably connecting the athletic goal to the ballast device, adapted to engage both the top surface and the edge of the deck and including a pair of plastic support posts respectively located at least partially within the athletic goal hollow metal posts.

14. An apparatus as claimed in claim 13, wherein the athletic goal comprises a water polo goal.

15. An apparatus as claimed in claim 13, wherein the support assembly includes horizontal members adapted to rest on the deck and downwardly extending members.

16. An apparatus as claimed in claim 13, wherein the ballast device is isolated from the athletic goal and support assembly such that the ballast material is prevented from entering the athletic goal and support assembly.

* * * * *